United States Patent [19]

Franklin

[11] 3,969,849

[45] July 20, 1976

[54] SELF-SUPPORTING LIGHTING FIXTURE

[76] Inventor: D. E. Franklin, 555 E. Rambling Drive, West Palm Beach, Fla. 33406

[22] Filed: May 12, 1975

[21] Appl. No.: 576,665

Related U.S. Application Data

[63] Continuation of Ser. No. 445,245, Feb. 25, 1974, abandoned.

[52] U.S. Cl. ..... 52/28; 52/40; 52/730; 240/25; 240/52 R; 240/84

[51] Int. Cl.[2] ..... F21V 21/00; E04H 14/00

[58] Field of Search ..... 240/25, 3, 9 R, 52 R, 240/64, 81 A, 84, 103 R, 81 R, 38; 52/730, 731, 28, 40

[56] References Cited

UNITED STATES PATENTS

| | | | |
|---|---|---|---|
| 1,656,871 | 1/1928 | Schnitzer | 52/731 X |
| 1,884,247 | 10/1972 | Riemenschnieder | 52/28 |
| 2,835,788 | 5/1958 | Phillips | 240/3 |
| 3,051,772 | 8/1962 | Davis | 240/9 X |
| 3,196,990 | 7/1965 | Handley | 52/40 |
| 3,728,837 | 4/1973 | Kiefer | 52/731 |
| 3,737,654 | 6/1973 | Hawley | 240/52 R |

*Primary Examiner*—Joseph F. Peters, Jr.

[57] ABSTRACT

A self-supporting lighting fixture which is used for night lighting of tennis courts or other gaming surfaces, parking lots and service areas, is constructed of a combination of longitudinal metal members to which are fastened sheets of reflective metal. These reflective sheets together with their associated longitudinal members form a body in the shape of a hollow prism. The whole fixture comprises a structure in which the reflective sheets are stressed and carry both bending and torsional stresses.

4 Claims, 4 Drawing Figures

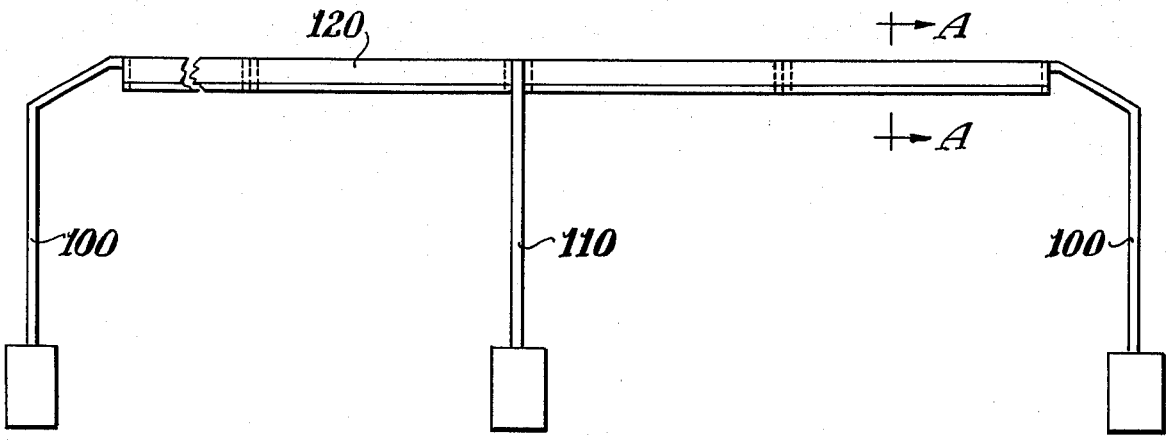
Fig. 1.
Fig. 2.
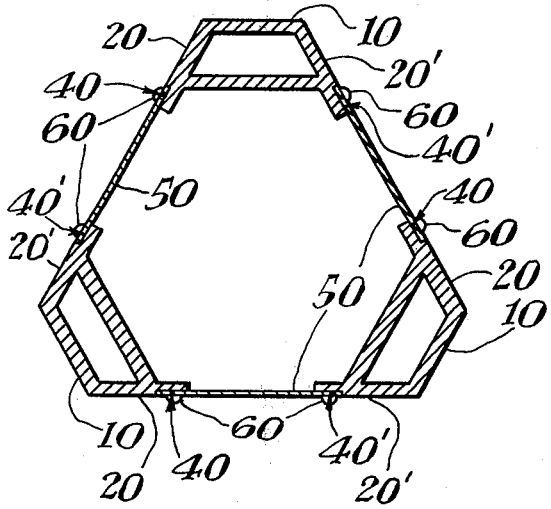
Fig. 3.
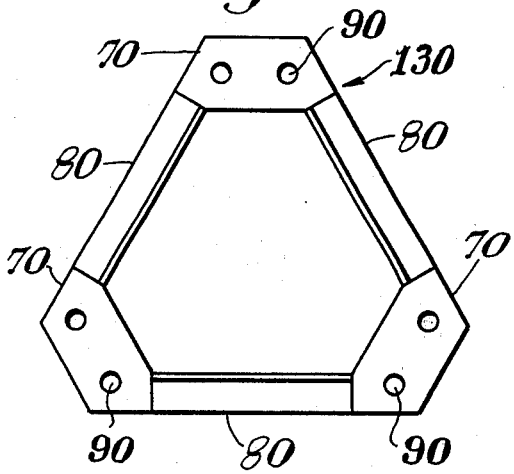
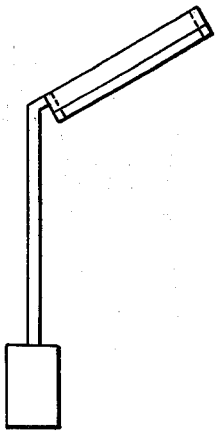
Fig. 4.

SELF-SUPPORTING LIGHTING FIXTURE

This is a continuation of application Ser. No. 445,245, filed Feb. 25, 1974, and now abandoned.

BACKGROUND OF THE INVENTION

Prior art lighting systems have required relatively short fixtures because the fixtures cannot support their own weight plus the associated wind loadings. These short fixtures require more vertical support per linear run-supports which often interfere with the utilization of the surfaces to be lighted. The present invention solves these problems in that its' lighting fixture is capable of carrying high bending and torsional stresses. Therefore, fewer vertical supports are required and the result is an uncluttered, aesthetically pleasing installation.

BRIEF DESCRIPTION OF THE INVENTION

The present invention relates to a new and improved lighting system disclosed herein constructed of aluminum or other suitable light-weight corrosion-resistant metal. The body of the lighting fixture itself is constructed from metal sheets and extrustions. The shape of this fixture is a hollow triangular prism in which the sheet metal sides meet at three apex joints. The joints are formed by fastening the sides of a sheet metal reflective surface to each side of the metal extrusion. By virtue of this construction, the sheet metal reflective surfaces carry bending and torsional stresses in addition to providing reflected light to the game surface. On a typical tennis court installation lighting fixtures are supported at either end and at the midpoint of the span by round aluminum or other metal posts. Only two court-length spans of lighting fixtures are required - one span along each side of the court. Because the fixture itself supports the bending and torsional stresses, the minimal post supports which are required are placed off the playing surface.

The general object of this invention is to provide a night lighting system for tennis courts or other surfaces.

A specific object of this invention is to provide such a lighting system which is simple and unobtrusive having an aesthetically pleasing over-all appearance.

Another specific object of this invention is to provide such a lighting system which will withstand light wind loads without excessive movement of the lighting fixtures.

Moreover, the system should be capable of withstanding high surface winds without structural damage.

In accordance with these and other objects which will be apparent hereinafter, the instant invention will now be described with particular reference to the accompanying drawing.

BRIEF DESCRIPTION OF THE DRAWINGS

In the drawings;

FIG. 1 is a side elevation of the entire system including the lighting fixtures, end and center support posts.

FIG. 2 is a sectional view of the lighting fixture in FIG. 1 looking in the direction of the arrows A—A.

FIG. 3 is a plan view of the structural end piece of the lengthy fixture.

FIG. 4 shows an elevation view of a modification of this invention wherein one lighting fixture having an end member fastened to it is then fastened to one vertical support post.

DESCRIPTION OF A PREFERRED EMBODIMENT

There is shown in FIG. 2 an aluminum or other suitable metal extrusion 10. The angle between the intersection of the planes of faces 20 and 20' is 60°. The plane faces 20 and 20' of extrusion 10 have a notch 40 and 40' which runs longitudinally the entire length of the extrusion 10. Lying in the notch 40/40' in such a way as to form a continuation of plane surfaces 20 and 20' is an aluminum or other suitable metal sheet 50 which both reflects light from the sources mounted adjacent to it and carries the stresses of bending and torsion placed upon the entire lighting fixture. The metal sheet 50 referred to is fastened to the extrusion 10 with rivets 60 such as those shown or by other suitable fastening means. The entire fixture assembly 120 as described in FIG. 2 is approximately 20 feet long as seen in FIG. 1.

Referring now to FIG. 3, at each end of the fixture assembly 120 described above is fastened a built-up metal end member 130 of substantially triangular shape which serves to connect the fixture 120 in any given instance to either an adjacent lighting fixture 120 or to an end post 100 or center support post 110.

Member 70 is fabricated from flat aluminum or other suitable stock in the shape of an irregular polygon. Three such members 70 form the apexes of the described triangular shape. To these, three angle-aluminum members 80 are fastened to form the sides of the triangle. Both the flat members 70 and the angle members 80 have sufficient holes 90 drilled or punched as necessary to receive bolts or rivets used to fasten this end member 130 to the lighting fixture 120 described above.

Referring to FIG. 1, two end support posts 100 and one center support post 110 are shown holding aloft and relatively long run of lighting fixtures 120. In this configuration the lighting system may be used to illuminate a tennis court or other similar surface.

The entire lighting fixture assembly described represents a structure in which the reflective metal skin is integral with and shares the stresses placed upon the longitudinal extrusions.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. A lightweight electrical lighting supporting fixture requiring a reduced number of vertical supports per length of fixture capable of withstanding relatively high wind velocities comprising:

at least three elongated relatively lightweight rigid supporting members;

a plurality of relatively thin lightweight reflecting elongated metal sheets, each of said sheets being substantially rectangular, each of said supporting members having angularly disposed sheet attaching walls and a bracing wall connected between said sheet attaching walls, said sheet attaching walls each having a notched edge disposed along the elongated longitudinal direction of said supporting member, said notched edges having a gap substantially equal to the thickness of one of said sheets, said supporting members disposed such that adjacent supporting members have adjacent sheet attaching walls disposed in a common plane enjoined together by one of said reflective thin sheets lying in said common plane, said sheet longitudinal edge portion being disposed in adjacent wall attaching notches;

a plurality of fasteners connecting said thin sheets to said supporting members; and at least two rigid frames, each of said frames connecting said supporting members together.

2. The device, as recited in Claim 1 wherein:

each of said supporting member sheet attaching walls form a substantially 60° angle with each other.

3. The device, as in Claim 2, wherein:

the supporting members are aluminum.

4. The device, as recited in Claim 3, including:

a rigid vertical supporting member connected to one of said frames.

* * * * *